US008287188B2

(12) United States Patent
Hoyord et al.

(10) Patent No.: US 8,287,188 B2
(45) Date of Patent: Oct. 16, 2012

(54) REUSABLE BAG

(75) Inventors: Daniel J. Hoyord, St. Paul, MN (US); Angela L. Baer, Westminster, MA (US); Sohil Arora, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 352 days.

(21) Appl. No.: 12/687,280

(22) Filed: Jan. 14, 2010

(65) Prior Publication Data

US 2011/0168765 A1 Jul. 14, 2011

(51) Int. Cl.
*B65D 30/00* (2006.01)
*B65D 33/10* (2006.01)
*B65D 30/22* (2006.01)

(52) U.S. Cl. ..... 383/4; 383/2; 383/7; 383/40

(58) Field of Classification Search ..... 383/2, 4, 383/7, 8, 40; 150/112; 190/103, 105, 109
See application file for complete search history.

(56) References Cited

U.S. PATENT DOCUMENTS

| | | | | |
|---|---|---|---|---|
| 1,286,104 | A * | 11/1918 | Reichmuth | 383/40 |
| 2,493,085 | A | 1/1950 | Pincus | |
| 2,533,850 | A * | 12/1950 | Syracuse | 150/117 |
| 4,011,898 | A | 3/1977 | Hubbard | |
| D244,884 | S | 6/1977 | Dotson | |
| D246,940 | S | 1/1978 | Sabol | |
| 4,117,874 | A | 10/1978 | Berenguer | |
| 4,119,127 | A | 10/1978 | Klug | |
| 4,640,411 | A * | 2/1987 | Fery | 206/216 |
| 4,782,874 | A | 11/1988 | Chartier | |
| 5,009,319 | A | 4/1991 | Jantzen | |
| 5,009,516 | A | 4/1991 | Geeck | |
| D317,226 | S | 6/1991 | Smith, Jr. et al. | |
| 5,046,860 | A | 9/1991 | Brennan | |
| 5,062,717 | A | 11/1991 | Shockley | |
| 5,127,536 | A | 7/1992 | Cohen et al. | |
| 5,152,612 | A | 10/1992 | Shoemaker | |
| 5,213,418 | A | 5/1993 | Dancy et al. | |
| 5,228,574 | A | 7/1993 | Rogers | |
| D341,486 | S | 11/1993 | Frank | |

(Continued)

FOREIGN PATENT DOCUMENTS

EP 1516750 A2 * 3/2005

(Continued)

OTHER PUBLICATIONS

"How to sew a curved bag gusset tutorial (aka reusable groceries bag with comfy bag handles)", pp. 1-15, Apr. 21, 2007. U-handblog, http://u-handbag.typepad.com/uhandblog/2007/04/on_of_the_medi.html.

(Continued)

*Primary Examiner* — Jes F Pascua
(74) *Attorney, Agent, or Firm* — Merek, Blackmon & Voorhees, LLC

(57) ABSTRACT

A bag includes a first portion. The first portion is attached to a second portion of the bag. The reusable bag also includes a mailing label having an addressee section preprinted with an address of a recycler. When the bag is in an unpacked state, the first portion is configured to carry items. When the bag is in a packed state, the first portion is secured in the packed state using the second portion such that the mailing label is visible.

17 Claims, 16 Drawing Sheets

U.S. PATENT DOCUMENTS

| | | | | |
|---|---|---|---|---|
| 5,297,872 | A | 3/1994 | Caligiuri | |
| 5,316,388 | A * | 5/1994 | Caligiuri | 383/127 |
| 5,370,461 | A * | 12/1994 | Smith et al. | 383/4 |
| 5,490,396 | A | 2/1996 | Morris | |
| D374,348 | S | 10/1996 | Sarver | |
| D383,903 | S | 9/1997 | Kopel | |
| 5,692,660 | A | 12/1997 | Stewart | |
| 5,742,883 | A * | 4/1998 | Girard et al. | 399/262 |
| 5,817,379 | A | 10/1998 | Rich et al. | |
| 5,836,095 | A | 11/1998 | Crowell | |
| D413,723 | S | 9/1999 | Quansah | |
| 6,095,686 | A | 8/2000 | Mohrmann | |
| D436,251 | S | 1/2001 | Guyon | |
| D439,040 | S | 3/2001 | Vazquez | |
| 6,230,950 | B1 | 5/2001 | Heetman | |
| 6,279,747 | B1 * | 8/2001 | Zegarra | 206/579 |
| D451,669 | S | 12/2001 | Guyon | |
| 6,550,617 | B1 | 4/2003 | Elva | |
| 6,640,856 | B1 | 11/2003 | Tucker | |
| D487,542 | S | 3/2004 | Slimane | |
| D516,306 | S | 3/2006 | Koenig et al. | |
| D535,098 | S | 1/2007 | Maier | |
| 7,222,446 | B2 | 5/2007 | Foster | |
| D544,710 | S | 6/2007 | Saconay-Duhart | |
| D587,009 | S | 2/2009 | Mailet | |
| D590,150 | S | 4/2009 | Miller | |
| 7,581,886 | B2 * | 9/2009 | Nitti | 383/4 |
| 7,958,920 | B1 * | 6/2011 | Olsson | 150/112 |
| 2003/0152294 | A1 | 8/2003 | Diep | |
| 2003/0152295 | A1 | 8/2003 | Dubsky | |
| 2005/0284718 | A1 | 12/2005 | Tai | |
| 2006/0201979 | A1 | 9/2006 | Achilles | |
| 2007/0102460 | A1 | 5/2007 | Lottman | |
| 2007/0108240 | A1 | 5/2007 | Berger | |
| 2007/0138222 | A1 | 6/2007 | Goldman | |
| 2007/0187487 | A1 | 8/2007 | Wilen | |
| 2007/0201772 | A1 | 8/2007 | Schindele | |
| 2008/0199107 | A1 | 8/2008 | Nicholson | |
| 2009/0050505 | A1 | 2/2009 | Rubin | |
| 2009/0080808 | A1 | 3/2009 | Hagen | |
| 2009/0152154 | A1 | 6/2009 | Coyne | |

FOREIGN PATENT DOCUMENTS

WO 01/87125 A1 11/2001

OTHER PUBLICATIONS

"Brown Bag It", Tyvek Market Bags, pp. 1-2, website last visited on Aug. 12, 2009. http://www.uncommongoods.com/item/item.jsp?itemId=15889.

ChicoBag, Frequently Asked Questions, pp. 1-2, website last visited on Mar. 31, 2009. http://www.chicobag.com/t-faq.aspx.

Tagnani, D., BackpackGearTest, "Outdoor Research Hydroseal Drycomp Airx", pp. 1-8, Jan. 27, 2008. http://www.backpackgeartest.org/reviews/Stuff Sacks/Compression Sacks/Outdoor Research Drycomp AirX Sacks/Test Report by David Tagnani/.

Waste Management LampTracker, p. 1, website last visited Sep. 2, 2009. http://earth911.com/recycling/mail-back-programs-recycling-from-home/.

Californians Against Waste, "Where to Recycle", pp. 1-6, website last visited on Sep. 2, 2009. http://www.cawrecycles.org/living_green/where_to_recycle.

Californians Against Waste, "Where to Recycle", T-Mobile, p. 1, website last visited on Sep. 2, 2009. http://www.cawrecycles.org/living_green/where_to_recycle.

"Mail-Back Programs: Recycling from Home", pp. 1-13, website last visited on Sep. 2, 2009. http://earth911.com/recycling/mail-back-programs-recycling-from-home/.

Colorado Department of Public Health and Environment, Mail-back Programs for Mercury, Lighting, Dental, Medical, and Electronic Wastes, pp. 1-4, Jul. 2009.

* cited by examiner

REUSABLE BAG

BACKGROUND

Reusable shopping bags are considered a sustainable alternative to using single-use plastic or paper bags when carrying groceries or other purchased items away from a retail establishment. The reusable bags are made of a durable material and can be reused many times over a given period of time.

A reusable bag is considered to be environmentally friendly in that its manufacture requires fewer natural resources and produces fewer emissions of harmful gases than a single-use bag. However, at some point the bag will wear out and become unusable to the owner. At that point, the bag will eventually find its way into a landfill.

A more environmentally friendly way of disposing of the bag is to recycle it. However, current neighborhood recycling programs generally do not include the recycling of materials used in the construction of reusable bags.

The discussion above is merely provided for general background information and is not intended to be used as an aid in determining the scope of the claimed subject matter.

SUMMARY

A reusable bag includes a first portion and a second portion. The second portion is attached to the first portion. The reusable bag also includes a mailing label having an addressee section preprinted with an address of a recycler. When the bag is in an unpacked state, the first portion is configured to carry items. When the bag is in a packed state, the first portion is secured in the packed state using the second portion such that the mailing label is visible.

The reusable bag can be disposed of in an environmentally friendly way. The second portion includes at least one of a hook and a loop material that mates with at least one of a hook and a loop material attached to the first portion to secure the reusable bag in the packed state. After being placed in the packed state, the reusable bag is deposited into a postal mail stream and is delivered according to the preprinted addressee section of the mailing label.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a reusable bag having features for being packed down and features for added environmental benefit. The reusable bag is made from a pliant and resilient material, such as durable synthetic fiber material, that can withstand high loads without tearing. For example, the reusable bag can be made from Tyvek®, a high-density polyethylene synthetic fiber material manufactured by E. I. du Pont de Nemours and Company. In one embodiment, the reusable bag includes a pocket for receiving the material of a main carrying compartment for packed storage. In another embodiment, the main carrying compartment can be rolled up and secured into a packed state for storage. While in the packed state, the reusable bag can be deposited into a postal mail stream and shipped to a recycler for recycling.

Figure 1:
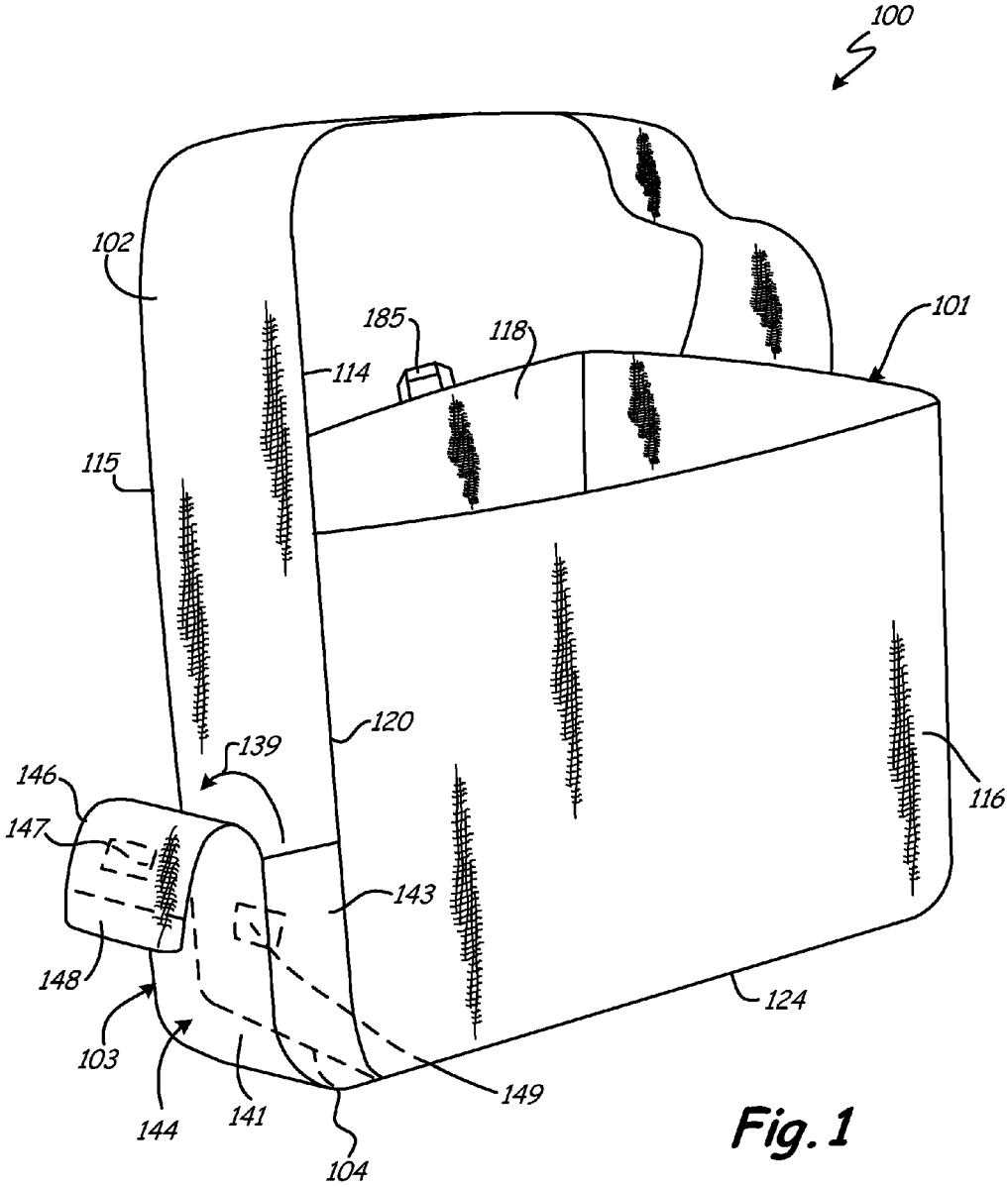
FIG. 1 is a front perspective view of an unpacked reusable bag under one embodiment.
Figure 2:
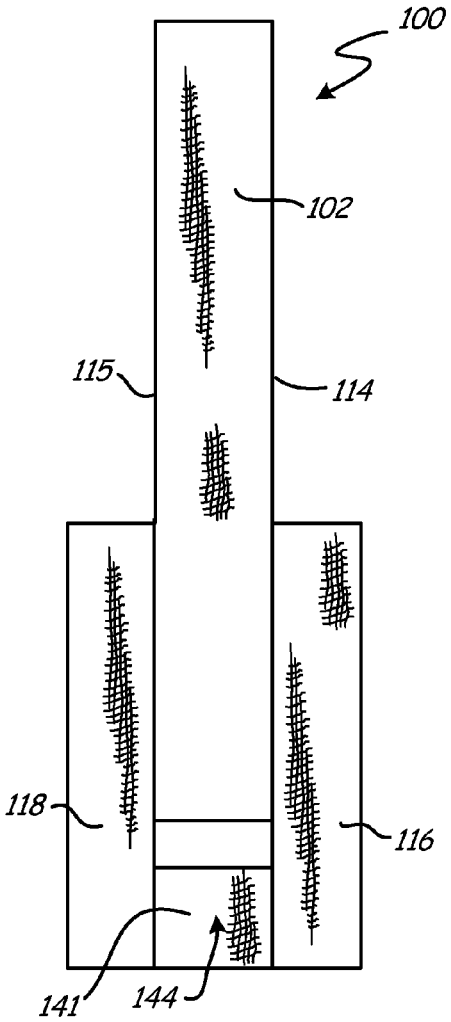
FIG. 2 is a front view of the unpacked reusable bag illustrated in FIG. 1.
Figure 3:
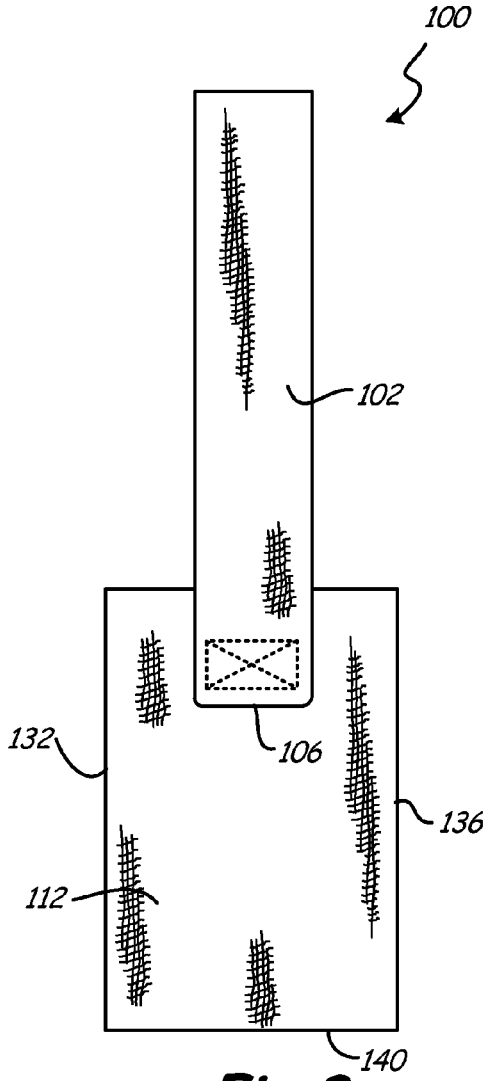
FIG. 3 is a back view of the unpacked reusable bag illustrated in FIG. 1.
Figure 4:
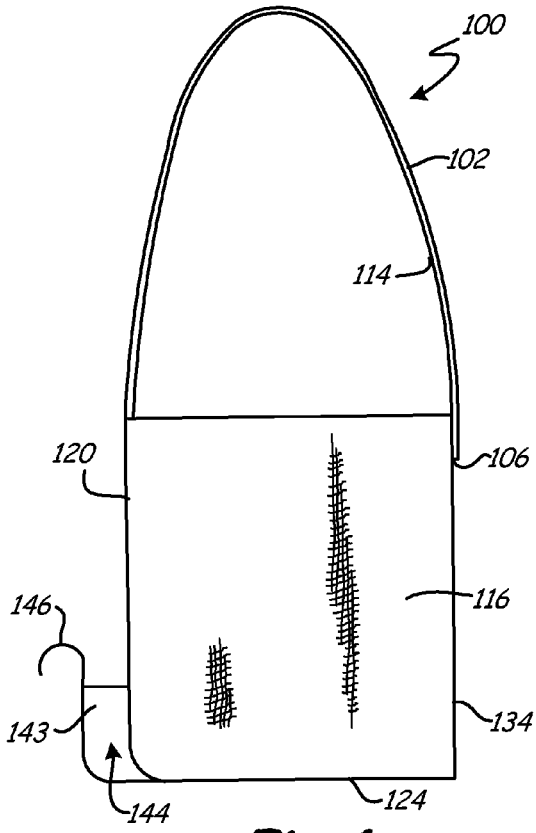
FIG. 4 is a right side view of the unpacked reusable bag illustrated in FIG. 1.
Figure 5:
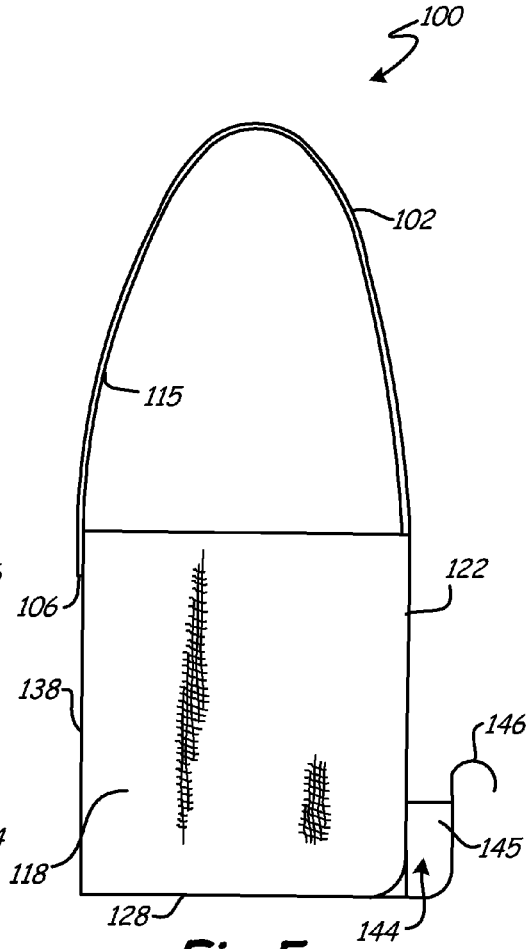
FIG. 5 is a left side view of the unpacked reusable bag illustrated in FIG. 1.
Figure 6:
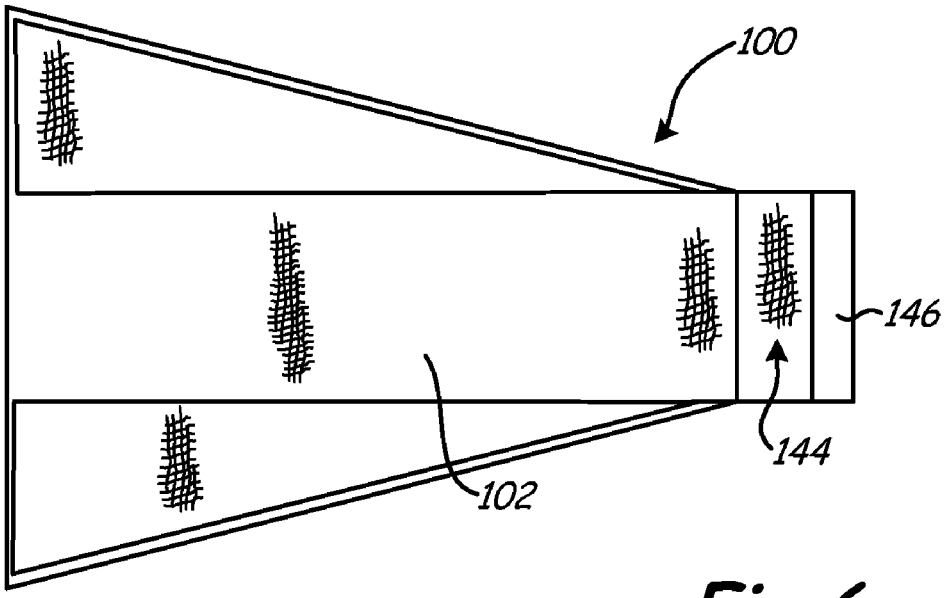
FIG. 6 is a top view of the unpacked reusable bag illustrated in FIG. 1.
Figure 7:
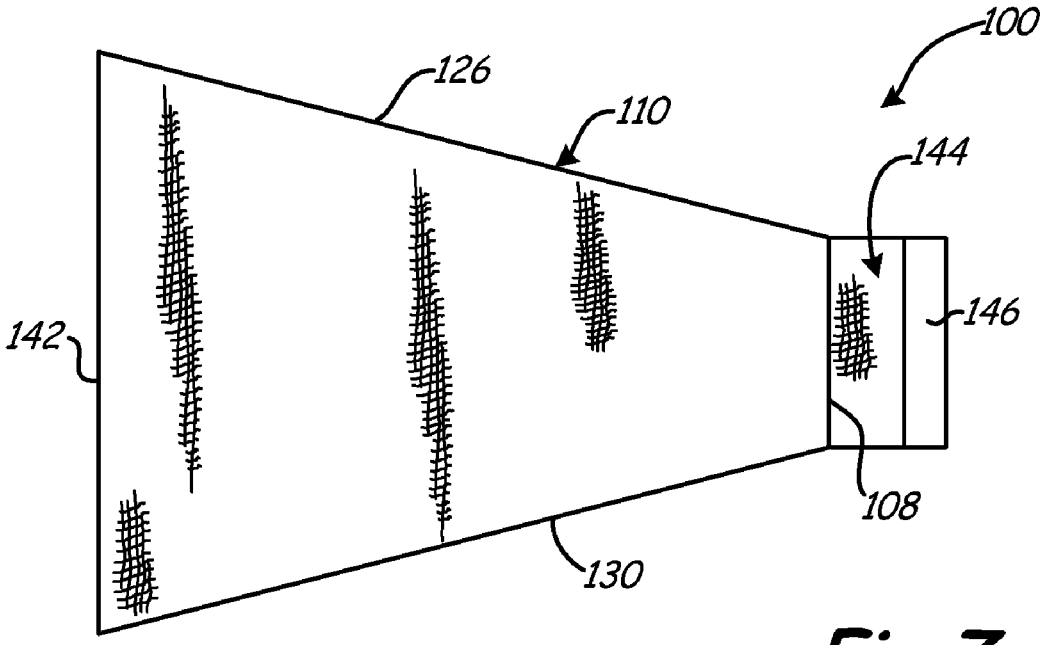
FIG. 7 is a bottom view of the unpacked reusable bag illustrated in FIG. 1.

FIG. 1 is a front perspective view, FIG. 2 is a front view, FIG. 3 is a back view, FIG. 4 is a right side view, FIG. 5 is a left side view, FIG. 6 is a top view and FIG. 7 is a bottom view of one embodiment of a reusable bag 100 in an unpacked state. In one embodiment, reusable bag 100 is a reusable shopping bag used as an alternative to single-use plastic or paper bags when carrying groceries or other purchased items away from a retail establishment. However, reusable bag 100 is not limited to such a purpose. Reusable bag 100 can be used to carry many different kinds of items for many different types of reasons. Reusable bag 100 also includes a loop 185. Loop 185 can be used with a bag rack for holding bags open while loading in purchased items.

Reusable bag 100 includes a first portion or main carrying compartment 101. First portion or main carrying compartment 101 includes a strap panel 102 having a first end edge 104 (FIG. 1) and a second end edge 106 (FIG. 3), a first lengthwise edge 114 and a second opposing lengthwise edge 115. First end edge 104 is attached, for example by stitching, to a front end 108 (FIG. 7) of bottom panel 110 (FIG. 7) of first portion 101. Second end edge 106 is attached, for example by stitching, to a back panel 112 (FIG. 3) of first portion 101. Part of lengthwise edge 114 is attached (e.g., stitched) to the front edge 120 (FIGS. 1 and 4) of right side panel 116. Part of lengthwise edge 115 is attached (e.g., stitched) to the front edge 122 (FIG. 5) of left side panel 118.

A bottom edge 124 (FIGS. 1 and 4) of right side panel 116 is attached (e.g., stitched) to a right edge 130 (FIG. 7) of bottom panel 110 and a bottom edge 128 (FIG. 5) of left side panel 118 is attached (e.g., stitched) to a left edge 126 (FIG. 7) of bottom panel 110. A right edge 132 (FIG. 3) of back panel 112 is attached (e.g., stitched) to a back edge 134 (FIG. 4) of right side panel 116, a left edge 136 (FIG. 3) of back panel 112 is attached (e.g., stitched) to a back edge 138 (FIG. 5) of left side panel 118 and a bottom edge 140 (FIG. 3) of back panel 112 is secured (e.g., stitched) to a back edge 142 (FIG. 7) of bottom panel 110.

Reusable bag 100 also includes a second portion 103. In the illustrated embodiment, second portion 103 can be a reversible storage pocket 144. Reversible storage pocket 144 (FIGS. 1, 2 and 4-7) includes a front panel 141 (FIGS. 1 and 2), a right side panel 143 (FIGS. 1 and 4) and a left side panel 145 (FIG. 5). Front panel 141 of pocket 144 is attached (e.g., stitched) to first end edge 104 of strap panel 102 at the front of the bag and to front edge 108 of bottom panel 110. Right side panel 143 of pocket 144 is attached to a portion of lengthwise edge 114 of strap panel 102, and left side panel 145 of pocket 144 is attached to a portion of lengthwise edge 115 of strap panel 102. Storage pocket 144 also includes a flap 146 (FIGS. 1 and 4-7). In the unpacked state, storage pocket 144 can be used to carry miscellaneous items, such as a beverage bottle, keys, sunglasses, etc.

Strap panel 102, bottom panel 110, back panel 112, right side panel 116 and left side panel 118 can be folded and packed into reversible storage pocket 144 for storing the bag. To accomplish this, the interior sides of storage pocket 144 when in the unpacked state are reversed to become exterior sides of the storage pocket 144 when in the packed state (see FIG. 8). This inversion is indicated by arrow 139 in FIG. 1. Then, strap panel 102, bottom panel 110, back panel 112, right side panel 116 and left side panel 118 are folded together and stuffed into the pocket 144 as illustrated in the perspective view of FIG. 8.

As illustrated in FIGS. 1 and 3, pocket 144 and first portion 101 include fastener components to secure pocket 144 shut when in a packed state or to orient flap 146 in pocket 144 when in an unpacked state so that it doesn't get caught on something or get in the way. For example, fastener components can include hook and loop material, such as Velcro®, to secure pocket 144 shut. In particular, pocket 144 includes a loop material 147 attached (e.g., by stitching) to flap 146 and a hook material 148 attached (e.g., by stitching) to flap 146 as shown in phantom lines in FIG. 1 and shown in FIG. 8 after pocket 144 is inverted for storing first portion 101. In addition, strap panel 102 includes a loop material 149. When in an unpacked state, as illustrated in FIG. 1, loop material 147 can mate with hook material 148 to orient flap 146 in pocket 144.

Figure 9:
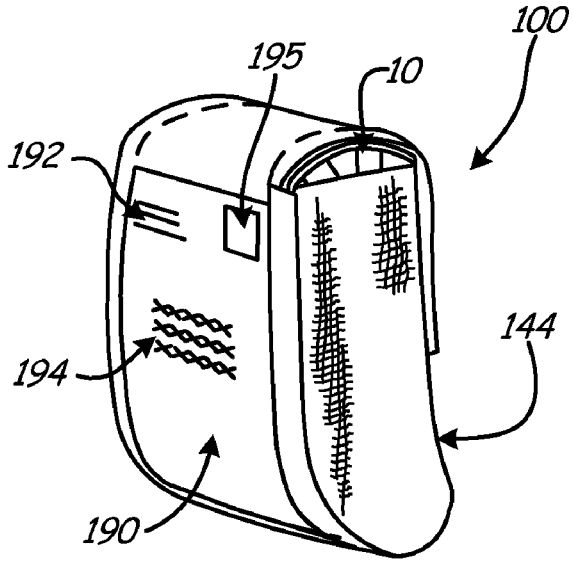
FIG. 9 is a perspective view of the reusable bag illustrated in FIG. 1 in a packed state.
Figure 10:
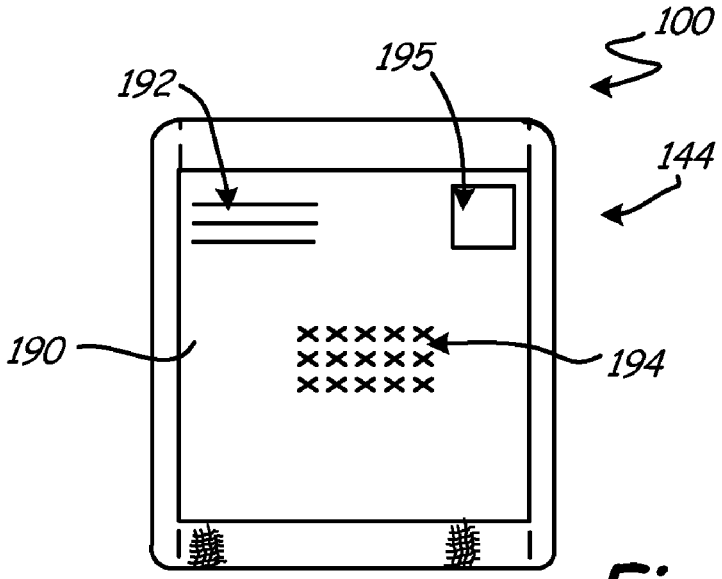
FIG. 10 is a front view of the reusable bag illustrated in FIG. 1 in a packed state.
Figure 11:
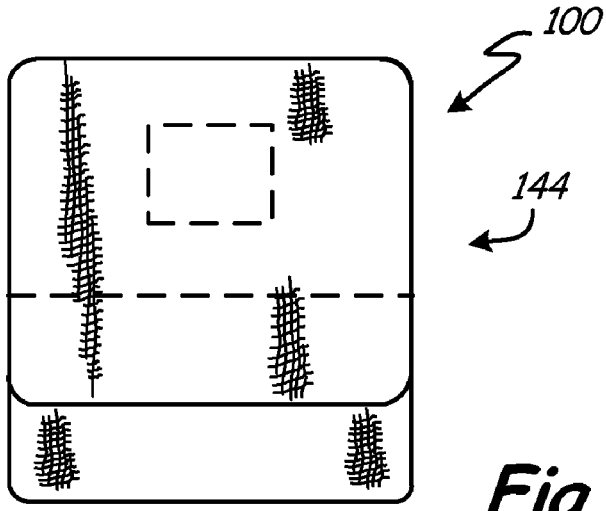
FIG. 11 is a back view of the reusable bag illustrated in FIG. 1 in a packed state.
Figure 12:
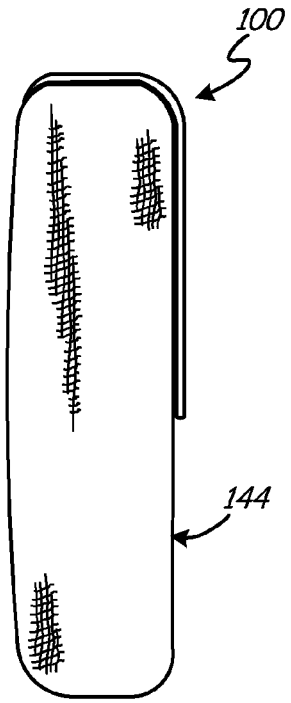
FIG. 12 is a right side view of the reusable bag illustrated in FIG. 1 in a packed state.
Figure 13:
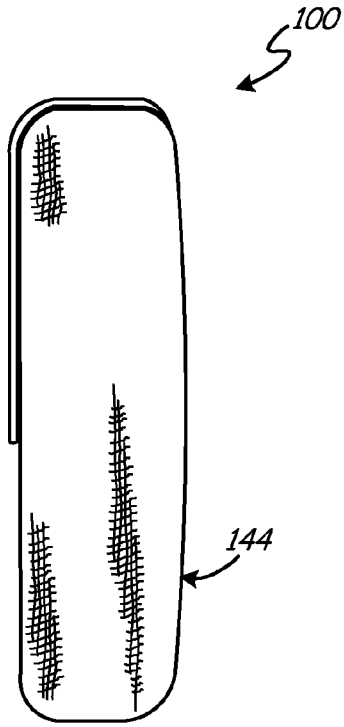
FIG. 13 is a left side view of the reusable bag illustrated in FIG. 1 in a packed state.
Figure 14:
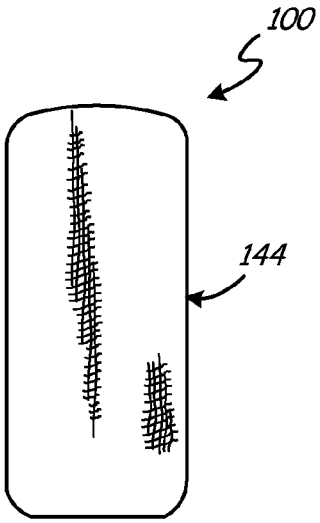
FIG. 14 is a top view of the reusable bag illustrated in FIG. 1 in a packed state.
Figure 15:
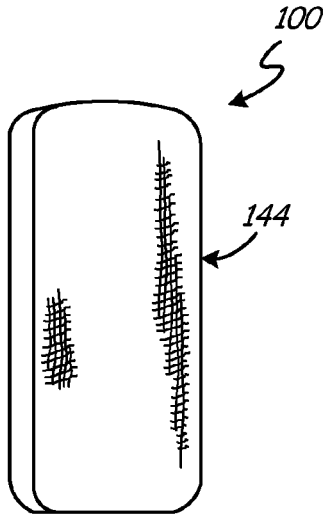
FIG. 15 is a bottom view of the reusable bag illustrated in FIG. 1 in a packed state.

FIG. 9 is a perspective view, FIG. 10 is a front view, FIG. 11 is a back view, FIG. 12 is a right side view, FIG. 13 is a left side view, FIG. 14 is a top view and FIG. 15 is a bottom view of reusable bag 100 in a packed state. When in a packed state, fastener components, such as hook material 148 and loop material 149 can mate to secure the first portion 101 in second portion 103 or pocket 144.

Figure 8:
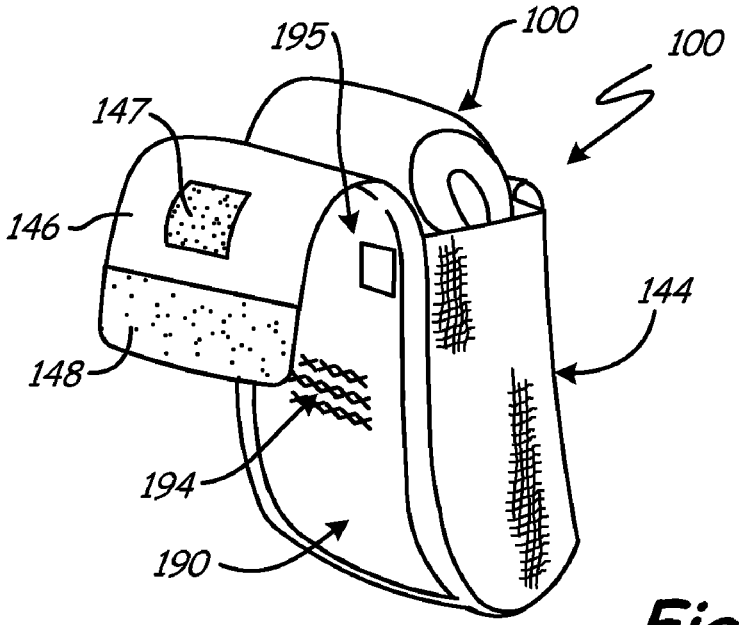
FIG. 8 is a perspective view of the reusable bag illustrated in FIG. 1 as being packed.

As illustrated in FIGS. 8-10, reusable bag 100 includes a mailing label 190 that is located on the interior sides of storage pocket 144 when in the unpacked state or otherwise on the exterior sides of the storage pocket 144 when in the packed state. Mailing label 190 can include a return address section 192 where the owner of the reusable bag 100 can fill in their return address. Mailing label 190 also includes an addressee section 194 that includes a preprinted address of a recycler and a postage section 195. Under one embodiment, postage section 195 can be a prepaid postage section so that an owner of reusable bag 100 can place it into a packed state and deposit it in a postal mail stream for sending or shipping to a recycler without paying any additional postage. In one embodiment, mailing label 190 can be attached to reusable bag 100 (e.g., by stitching). In other embodiments, mailing label 190 can be printed directly on the material of reusable bag 100.

Figure 16:
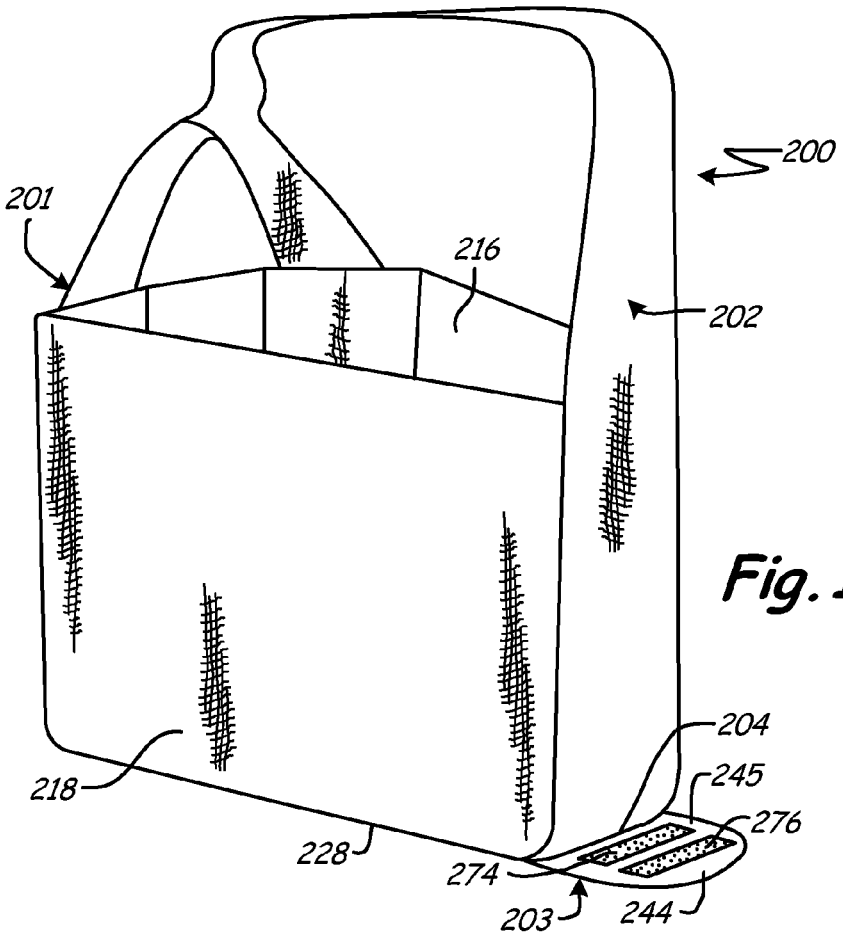
FIG. 16 illustrates a front perspective view of an unpacked reusable bag under another embodiment.
Figure 17:
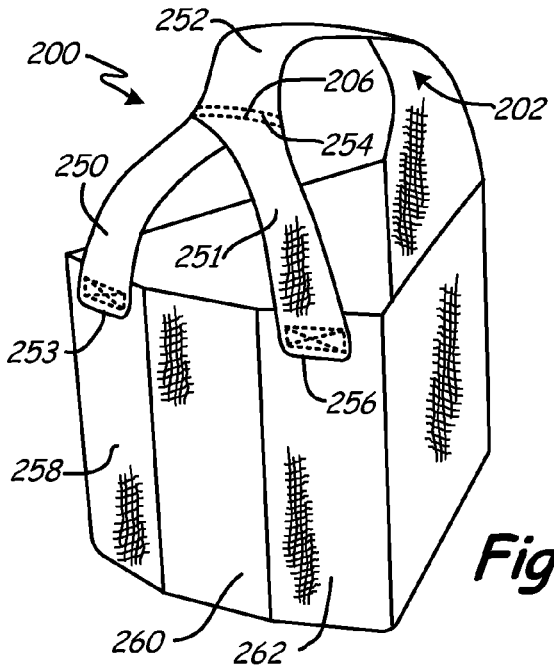
FIG. 17 is a back perspective view of the unpacked reusable bag illustrated in FIG. 16.
Figure 18:
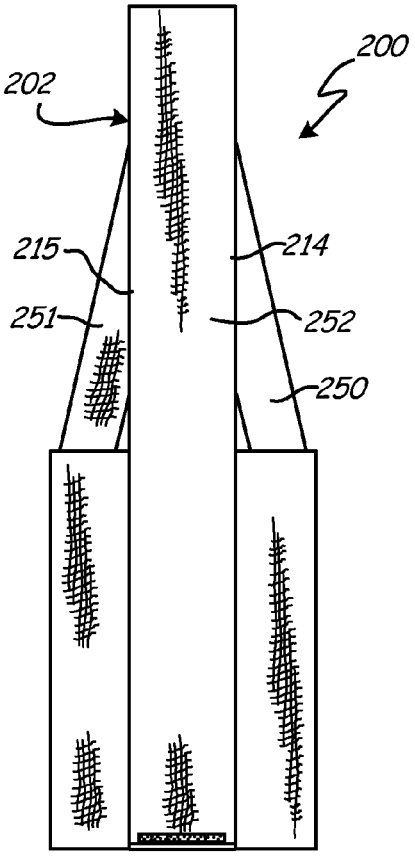
FIG. 18 is a front view of the unpacked reusable bag illustrated in FIG. 16.
Figure 19:
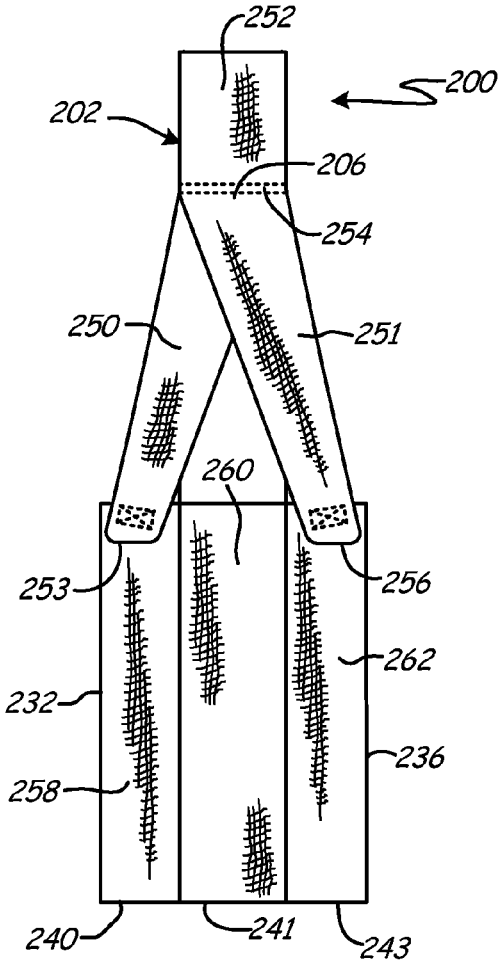
FIG. 19 is a back view of the unpacked reusable bag illustrated in FIG. 16.
Figure 20:
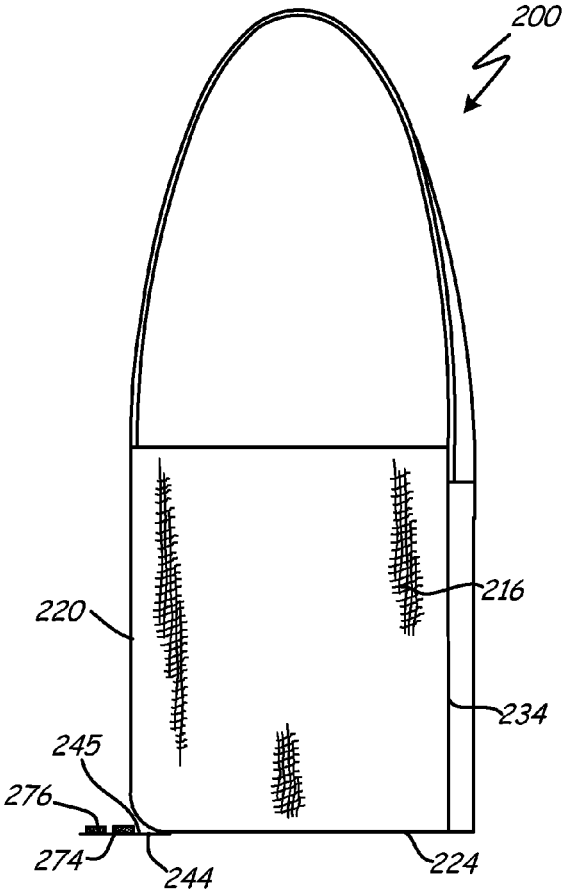
FIG. 20 is a right side view of the unpacked reusable bag illustrated in FIG. 16.
Figure 21:
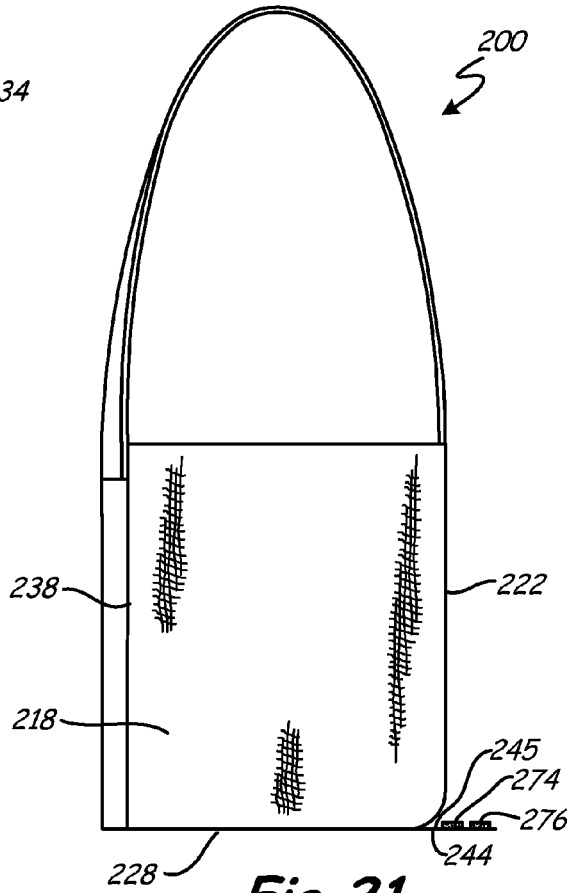
FIG. 21 is a left side view of the unpacked reusable bag illustrated in FIG. 16.
Figure 22:
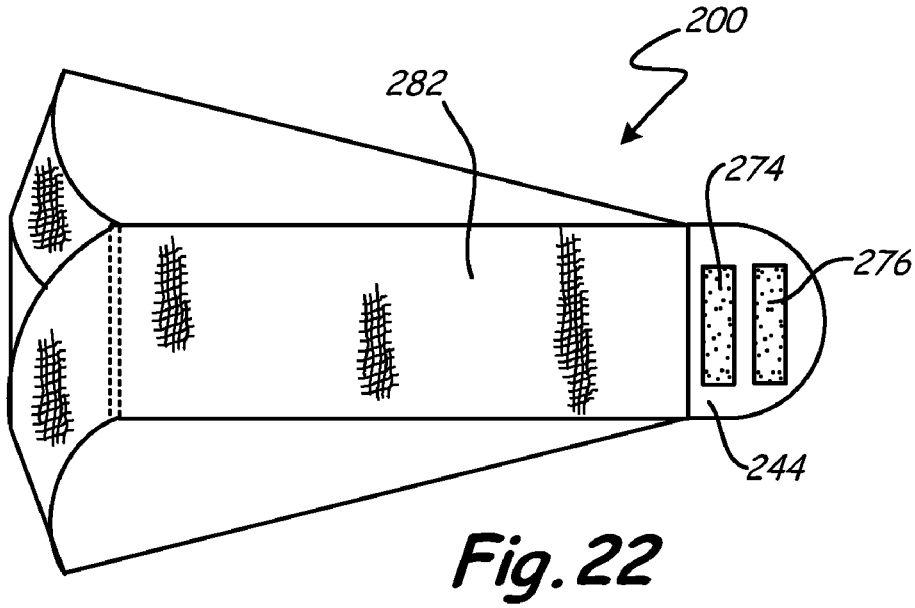
FIG. 22 is a top view of the unpacked reusable bag illustrated in FIG. 16.
Figure 23:
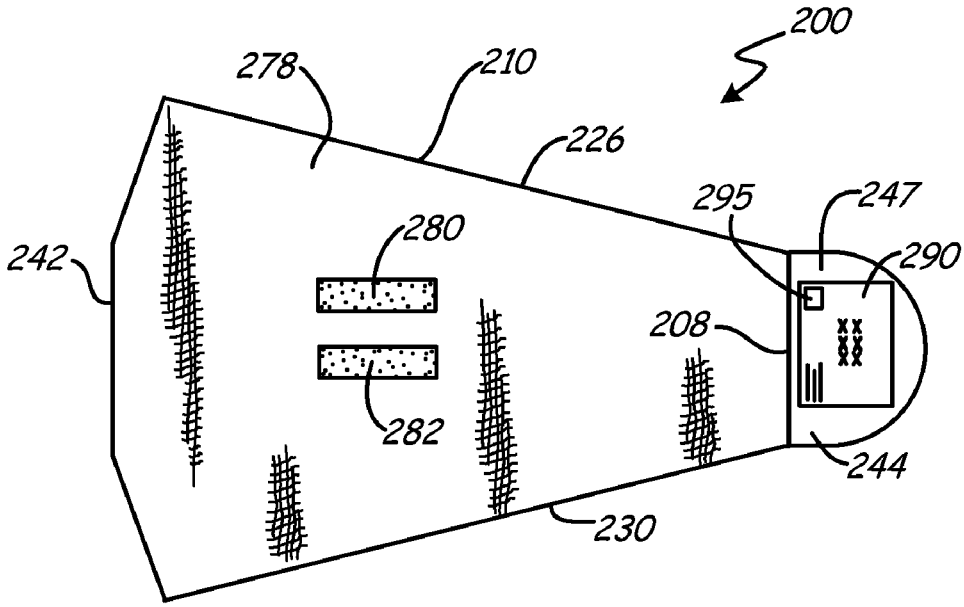
FIG. 23 is a bottom view of the unpacked reusable bag illustrated in FIG. 16

FIG. 16 is a front perspective view, FIG. 17 is a back perspective view, FIG. 18 is a front view, FIG. 19 is a back view, FIG. 20 is a right side view, FIG. 21 is a left side view, FIG. 22 is a top view and FIG. 23 is a bottom view of another embodiment of a reusable bag 200 in an unpacked state. In one embodiment, reusable bag 200 is a reusable shopping bag used as an alternative to single-use plastic or paper bags when carrying groceries or other purchased items away from a retail establishment. However, reusable bag 200 is not limited to such a purpose. Bag 200 can be used to carry many different kinds of items for many different reasons.

Reusable bag 200 includes a first portion or main carrying compartment 201. First portion or main carrying compartment 201 includes a strap panel 202 having a first piece 250, a second piece 251 and a third piece 252 (FIGS. 17 and 19). Third piece 252 includes a first end edge 204 (FIG. 16) and a second end edge 206 (FIG. 17). First piece 250 includes a first end edge (hidden from view) and a second end edge 253 (FIGS. 17 and 19). Second piece 251 includes a first end edge 254 (FIG. 17) and a second end edge 256 (FIGS. 17 and 19). First end edge 204 of third piece 252 is attached, for example by stitching, to a front end 208 (FIG. 23) of bottom panel 210 (FIG. 23). Second end edge 206 of third piece 252 is attached, for example by stitching, to the first end edge of first piece 250 and to first end edge 254 of second piece 251. Second end edges 253 and 256 of first and second pieces 250 and 251 are attached, for example by stitching, to a back of reusable bag 100. The back of reusable bag 200 includes a first panel 258, a third panel 262 and a second panel 260 located and between the first panel and the third panel with one side stitched to the first panel and the opposing side stitched to the third panel. As illustrated in FIG. 19, second end edge 253 of first piece 250 is attached, for example by stitching, to first panel 258 of the back. Second end edge 256 of second piece 251 is attached, for example by stitching, to third panel 262 of the back.

Third piece 252 of strap panel 202 includes opposing lengthwise edges 214 and 215 (FIG. 18). Part of lengthwise edge 214 is attached (e.g., stitched) to the front edge 220 (FIG. 20) of right side panel 216. Part of lengthwise edge 215 is attached (e.g., stitched) to the front edge 222 (FIG. 21) of left side panel 218. As illustrated in FIGS. 17, 18 and 19, first piece 251 and second piece 252 extend from second end edge 206 at an angle relative to lengthwise edges 214 and 215 of strap panel 202 such that the angle between first piece and second piece is an acute angle.

A bottom edge 224 (FIG. 20) of right side panel 216 is attached (e.g., stitched) to a right edge 230 of bottom panel 210 and a bottom edge 228 (FIGS. 16 and 21) of left side panel 218 is attached (e.g., stitched) to a left edge 226 of bottom panel 210. A right edge 232 (FIG. 19) of first panel 258 of the back is attached (e.g., stitched) to a back edge 234 (FIG. 20) of right side panel 216. A left edge 236 (FIG. 19) of third panel 262 of the back is attached (e.g., stitched) to a back edge 238 (FIG. 21) of left side panel 218 and bottom edges 240, 241 and 243 (FIG. 19) of first, second and third panels 258, 260 and 262, respectively, of the back are attached (e.g., stitched) to a back edge 242 (FIG. 23) of bottom panel 210.

Figure 24:
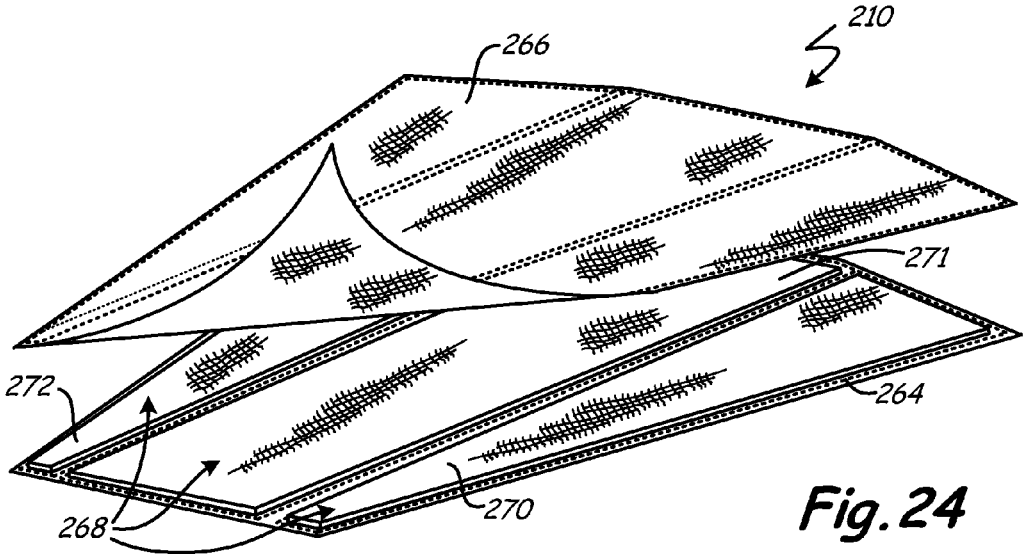
FIG. 24 illustrates a perspective view of the construction of the bottom panel of the reusable bag illustrated in FIGS. 16-23.
Figure 25:
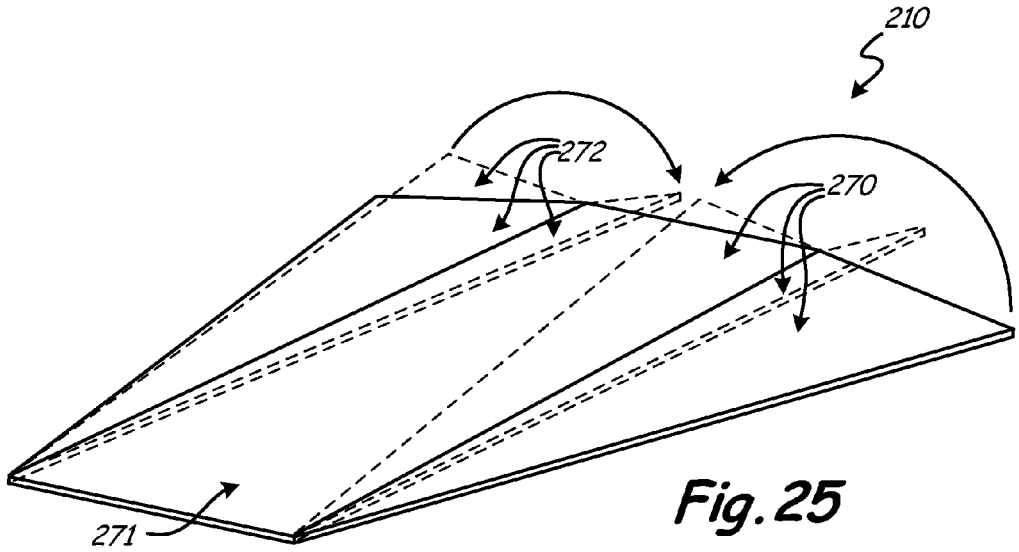
FIG. 25 illustrates how the bottom panel of the reusable bag illustrated in FIGS. 16-23 can be folded up for packing.

FIGS. 24 and 25 are detailed illustrations of bottom panel 210 of reusable bag 200. Bottom panel 210 includes a first layer of material 264 and a second layer of material 266. Positioned between the material layers 264 and 266 is a board-type material 268. For example, the board-type material 268 can comprise high density polyethylene (HDPE) and the like. The layers of material 264 and 266 are attached together, for example by stitching, to sandwich the board-type material and provide bottom panel 210 with structural integrity. As illustrated in FIG. 24, board-type material 268 can include three pieces 270, 271 and 272. Therefore, first layer of material 264 and second layer of material 266 are stitched together not only along the periphery of the layers but also in the space between the pieces 270, 271 and 272 of board-type material.

The placement of the pieces 270, 271 and 272 of board-type material also provides a way for bottom panel 210 to be folded together for compressing reusable bag 200 from an unpacked state into a packed state. As illustrated in FIG. 25, first piece 270 can be folded inwardly to rest on second piece 271 and third piece 272 can be folded inwardly to rest on second piece 271.

With reference back to FIGS. 16-23, reusable bag 200 includes a second portion 203. In the illustrated embodiment, second portion 203 can be a flap 244 (FIGS. 16 and 20-23) for securing the bag into a packed state. Flap 244 is attached (e.g., stitched) to first end edge 204 of strap panel 202 and front edge 208 of bottom panel 210. Flap 244 and bottom panel 210 include fastener components to secure bag 200 into the packed state. For example, flap 244 can include hook material and loop material, such as Velcro®. As illustrated in FIGS. 16 and 20-22, the top surface 245 of flap 244 can include loop material 274 and hook material 276 spaced apart from each other and oriented side-by-side in parallel. As illustrated in FIG. 23, a bottom surface 278 of bottom panel 210 can include loop material 280 and hook material 282 spaced apart from each other and oriented side-by-side in parallel. In particular, loop material 280 and hook material 282 can be oriented perpendicular to loop material 274 and hook material 276.

Figure 26:
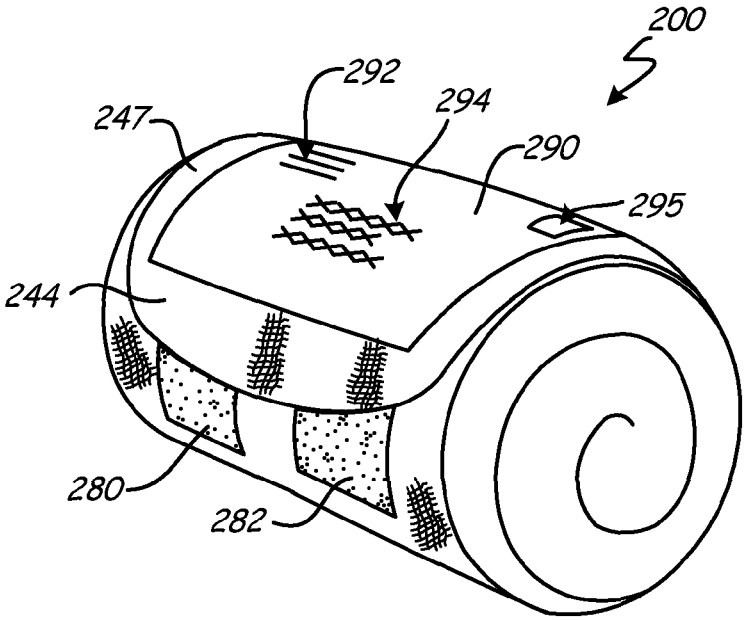
FIG. 26 illustrates a perspective view of the reusable bag illustrated in FIGS. 16-23 in a packed state.
Figure 27:
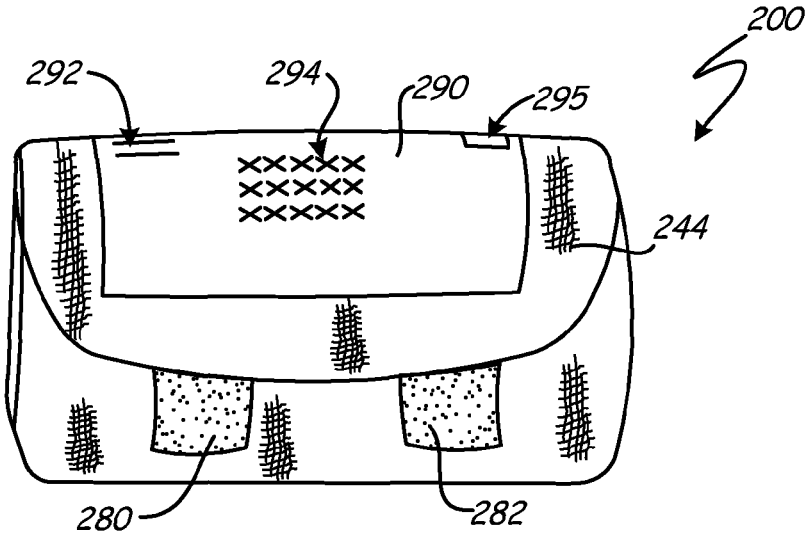
FIG. 27 is a front view of the reusable bag illustrated in FIG. 26.
Figure 28:
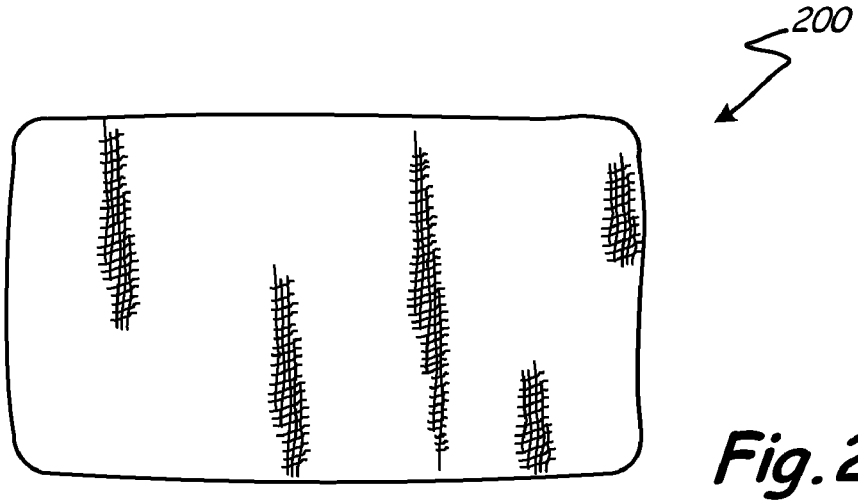
FIG. 28 is a back view of the reusable bag illustrated in FIG. 26.
Figure 29:
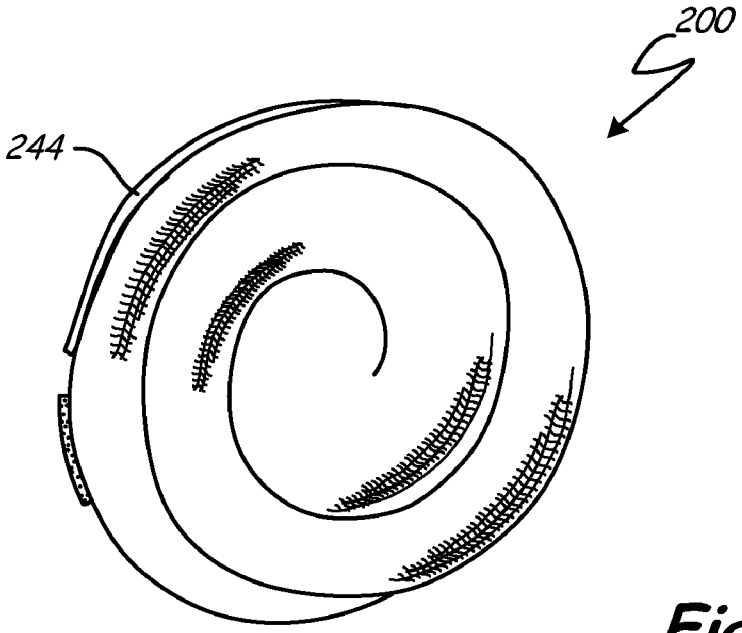
FIG. 29 is a right side view of the reusable bag illustrated in FIG. 26.
Figure 30:
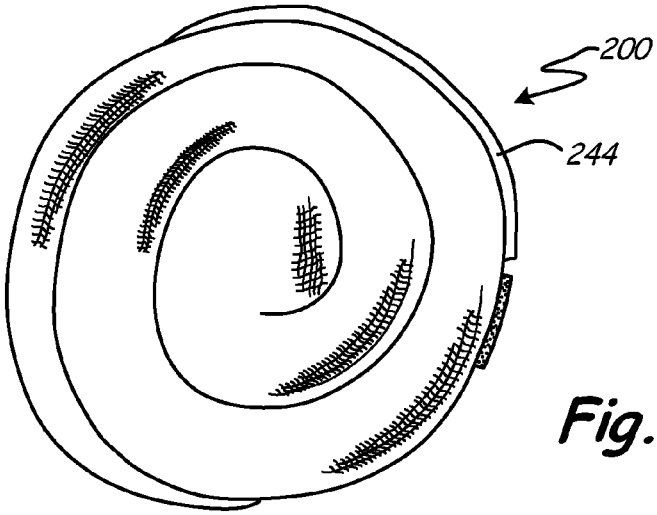
FIG. 30 is a left side view of the reusable bag illustrated in FIG. 26.
Figure 31:
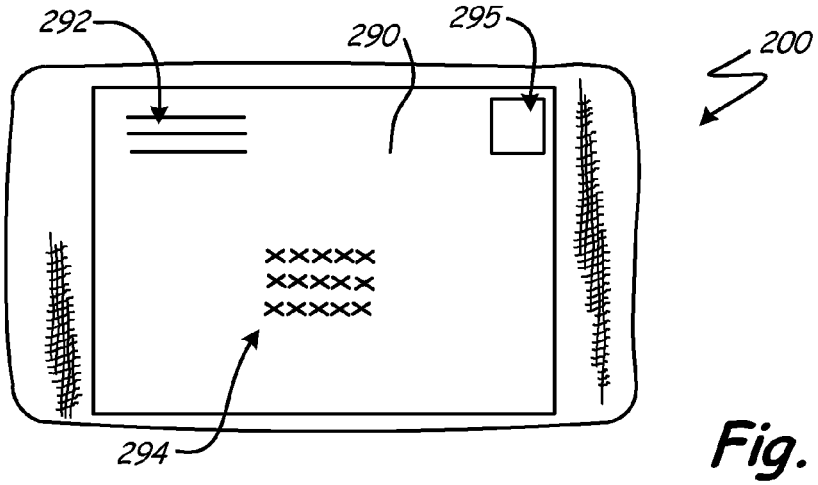
FIG. 31 is a top view of the reusable bag illustrated in FIG. 26.
Figure 32:
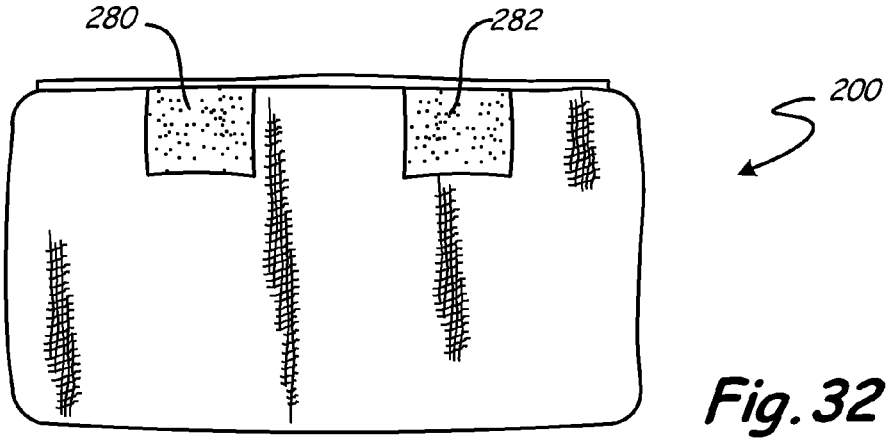
FIG. 32 is a bottom view of the reusable bag illustrated in FIG. 26.

FIG. 26 is a perspective view, FIG. 27 is a front view, FIG. 28 is a back view, FIG. 29 is a right side view, FIG. 30 is a left side view, FIG. 31 is a top view and FIG. 32 is a bottom view of reusable bag 200 rolled into a packed state. Reusable bag 200 is folded together as illustrated in FIG. 25 and then rolled into the configuration illustrated in FIGS. 26-32 such that fastener components, such as loop material 280 and hook material 282 can mate with the loop material 274 and hook material 276 (hidden from view in FIGS. 26-32) of flap 244.

As illustrated in FIGS. 23, 26, 27 and 31, reusable bag 200 includes a mailing label 290 located on a bottom surface 247 of the flap 244 that is opposite top surface 245. Mailing label 290 can include a return address section 292 where the owner of the reusable bag 200 can fill in their return address. Mailing label 290 can also include an addressee section 294 that includes a preprinted address of a recycler and a postage section 295. Under one embodiment, postage section 195 can be a prepaid postage section. Therefore, an owner of reusable bag 200 can place it into a packed state and deposit it in a postal mail stream for sending or shipping to a recycler without paying any additional postage. In one embodiment, mailing label 290 can be attached to reusable bag 200 by for example, stitching. In other embodiments, mailing label 290 can be printed directly on the material of reusable bag 200.

Figure 33:
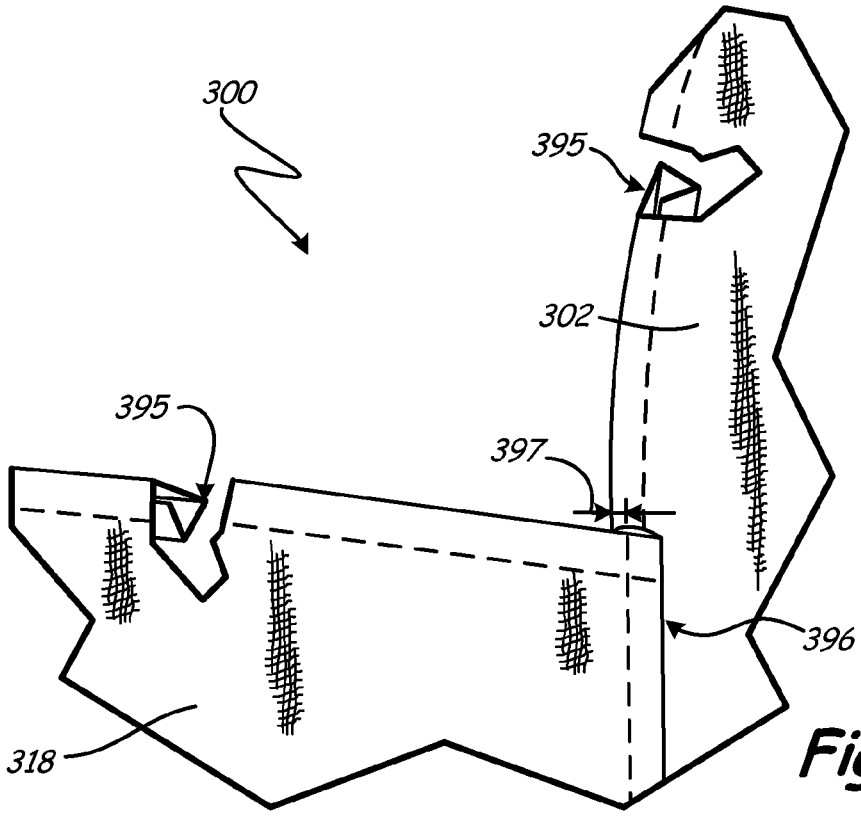
FIG. 33 illustrates an enlarged view of the seam construction of a reusable bag under yet another embodiment.

FIG. 33 illustrates an enlarged view of the seam construction of a reusable bag 300 under yet another embodiment. As illustrated at 395, each exposed edge of the reusable bag 300 has a doubled-folded hem. As illustrated, each unexposed edge of reusable bag 300 is stitched to an adjacent panel. For example, in FIG. 33, the edge 396 of left side panel 318 is stitched to strap panel 302. As also illustrated at 397, a seam allowance is given on left side panel 318 relative to strap panel 302.

Figure 34:
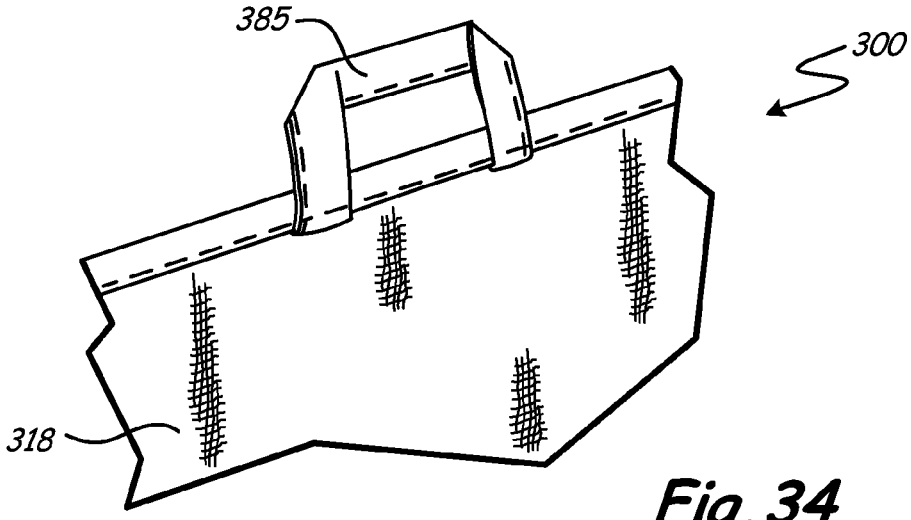
FIG. 34 illustrates an enlarged view of a loop sewn into the construction of the reusable bag illustrated in FIG. 33.

FIG. 34 illustrates an enlarged view of a loop 385 sewn into the construction of reusable bag 300. Reusable bag 300 includes a loop 385 sewn to a side panel, such as left side panel 318. In this embodiment, loop 385 is a folded Tyvek® loop that is sewn into the exposed top hem of left side panel 318. Loop 385 can be used with a bag rack for holding bags open while loading in purchased items.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bag comprising:

a first portion;

a second portion attached to the first portion;

the second portion having a mailing label having an addressee section preprinted with an address of a recycler;

wherein when the bag is in an unpacked state, the first portion is configured to carry items;

wherein when the bag is in a packed state, the first portion is packed down and secured in the packed state using the second portion such that the mailing label is visible;

wherein the first portion is defined by a plurality of assembled panels comprising: right and left side panels having front edges, back edges and bottom edges, the front edges of the right and left side panels being attached to portions of a strap panel;

a back panel attached to the back edges of the right and left side panels and having a bottom edge; and a bottom panel attached to the bottom edges of the right and left side panels and the back panel.

2. The bag of claim 1, wherein the second portion is at least attached to the first portion at a first end edge of the strap panel.

3. The bag of claim 1, wherein the second portion comprises a storage pocket having a front panel, a right side panel and a left side panel, wherein the front panel of the storage pocket is attached to a first end edge of the strap panel and the left side panel and the right side panel of the storage pocket are attached to portions of lengthwise edges of the strap panel.

4. The bag of claim 3, wherein when the bag is in an unpacked state, the first portion defined by the plurality of panels and the storage pocket are configured to carry items and wherein when the bag is in a packed state, the plurality of assembled panels defining the first portion are stuffed and secured into the storage pocket.

5. The bag of claim 1, wherein the second portion comprises a flap having at least one fastener component.

6. The bag of claim 5, wherein when the bag is in a packed state the plurality of assembled panels defining the first portion are folded, rolled and secured together using the at least one fastener component located on the flap.

7. The bag of claim 1, wherein the first portion and the second portion are made of a high-density polyethylene synthetic fiber material.

8. The bag of claim 1, wherein the mailing label further comprises a postage section.

9. The bag of claim 8, wherein the postage section comprises a prepaid postage section such that a packed reusable bag can be placed in a postal mail stream without additional postage.

10. A reusable bag comprising:

a main carrying compartment;

a storage pocket attached to the main carrying compartment;

a mailing label having an addressee section preprinted with an address of a recycler;

the mailing label being located on the storage pocket;

wherein when the reusable bag is in an unpacked state, the main carrying compartment and the storage pocket are configured to carry items;

wherein when the reusable bag is in a packed state, the main carrying compartment is stuffed and secured into the storage pocket;

wherein the main carrying compartment is defined by a plurality of assembled panels comprising:

right and left side panels having front edges, back edges and bottom edges, the front edges of the right and left side panels are attached to portions of a strap panel;

a back panel attached to the back edges of the right and left side panels and having a bottom edge; and a bottom panel attached to the bottom edges of the right and left side panels and the back panel.

11. The reusable bag of claim 10, wherein the main carrying compartment and the storage pocket are made of a resilient and pliant material, wherein the mailing label is printed on the material of the storage pocket.

12. The reusable bag of claim 10, wherein the main carrying compartment and the storage pocket are made of a high-density polyethylene synthetic fiber material.

13. The reusable bag of claim 10, wherein the storage pocket comprises a front panel, a right side panel and a left side panel, wherein the front panel of the storage pocket is attached to a first end edge of the strap panel and the left side panel and the right side panel of the storage pocket are attached to portions of lengthwise edges of the strap panel.

14. The reusable bag of claim 13, wherein interior sides of the storage pocket when the reusable bag is in the unpacked state are reversed to become the exterior sides of the storage pocket when the reusable bag is in the packed state.

15. The reusable bag of claim 14, wherein the storage pocket comprises a flap for securing the main carrying compartment in the storage pocket when the reusable bag is in the packed state.

16. The reusable bag of claim 10, wherein the mailing label further comprises a postage section.

17. The reusable bag of claim 16, wherein the postage section further comprises a prepaid postage section such that a packed reusable bag can be placed in a posting system without further postage.

* * * * *